United States Patent [19]

Kowalski

[11] Patent Number: 4,768,058

[45] Date of Patent: Aug. 30, 1988

[54] REPRODUCTION APPARATUS WITH EVERTING BELLOWS

[75] Inventor: Gregory L. Kowalski, Fairport, N.Y.

[73] Assignee: Eastman Kodak Company, Rochester, N.Y.

[21] Appl. No.: 95,197

[22] Filed: Sep. 11, 1987

[51] Int. Cl.[4] ..... G03G 15/00; G03G 15/26

[52] U.S. Cl. ..... 355/8; 355/3 R; 355/14 R; 355/55; 354/194

[58] Field of Search ..... 355/8, 3 R, 14 R, 55, 355/133, 77; 354/193, 194; 222/529

[56] References Cited

U.S. PATENT DOCUMENTS

| | | | |
|---|---|---|---|
| 3,955,207 | 5/1976 | Ort et al. | 354/194 |
| 3,977,013 | 8/1976 | Svatek | 354/194 X |
| 4,095,728 | 6/1978 | Chlystun | 222/529 |
| 4,181,415 | 1/1980 | Uchiyama et al. | 354/193 X |
| 4,241,986 | 12/1980 | Thomson | 354/193 |

*Primary Examiner*—A. C. Prescott

*Attorney, Agent, or Firm*—Norman Rushefsky

[57] ABSTRACT

A bellows for use in an exposure station of an electrophotographic copier or other reproduction apparatus. The bellows has one end thereof coupled to a movable lens for changing the image reduction/magnification ratio of the station. The lens movement is such that movement of the lens from one extreme imaging position to another extreme imaging position is accomplished by everting of the bellows to permit for a more compact bellows design.

2 Claims, 3 Drawing Sheets

REPRODUCTION APPARATUS WITH EVERTING BELLOWS

FIELD OF THE INVENTION

This invention relates to optical reproduction apparatus employing bellows.

DESCRIPTION OF THE PRIOR ART

In the prior art, it is known to provide reproduction apparatus wherein a subject scene or document to be reproduced is imaged upon a radiation sensitized plate, film or other recording member employing a lens which serves to image the object upon a radiation sensitive member. Such apparatus may comprise camera, copiers etc. In this art, it is known to employ bellows to block exposure of the radiation sensitive member to radiation not passing through the lens, but yet to allow movement of the lens relative to the member.

In U.S. Pat. No. 4,241,986, a folding camera is described wherein when the camera is folded into its storage position, the bellow everts to make the camera more compact when folded.

It is an object of the invention to provide reproduction apparatus which provides for movement of a lens relative to an image receiving member which allows an image to be formed on the member with more than one position of the lens and wherein a compact bellows is used to block extraneous radiation from a radiation exposure path.

SUMMARY OF THE INVENTION

The above and other objects of the invention are realized by a reproduction apparatus which comprises:

means for supporting a radiation sensitive member for exposure;

optical means including one or more optical elements for forming an image on said radiation sensitive member;

means for supporting an optical element of said optical means in each of at least two positions, in both of which positions the optical element is positioned in an optical path for forming an image upon the member;

a bellows coupled to said optical element; and means for supporting said bellows such that the orientation of the bellows is everted, when in one of said at least two positions versus its orientation in the other of said at least two positions.

For a fuller understanding of the nature and objects of my invention, reference should be made to the following detailed description taken in conjunction with the accompanying drawings.

BRIEF DESCRIPTION OF THE DRAWINGS

The subsequent description of the preferred embodiment of the present invention refers to the attached drawings wherein.

DETAILED DESCRIPTION OF THE PREFERRED EMBODIMENTS

Because electrophotographic reproduction apparatus are well known, the present description will be directed in particular to elements forming part of, or cooperating more directly with, the present invention. Apparatus not specifically shown or described herein are selectable from those known in the prior art.

Figure 1:
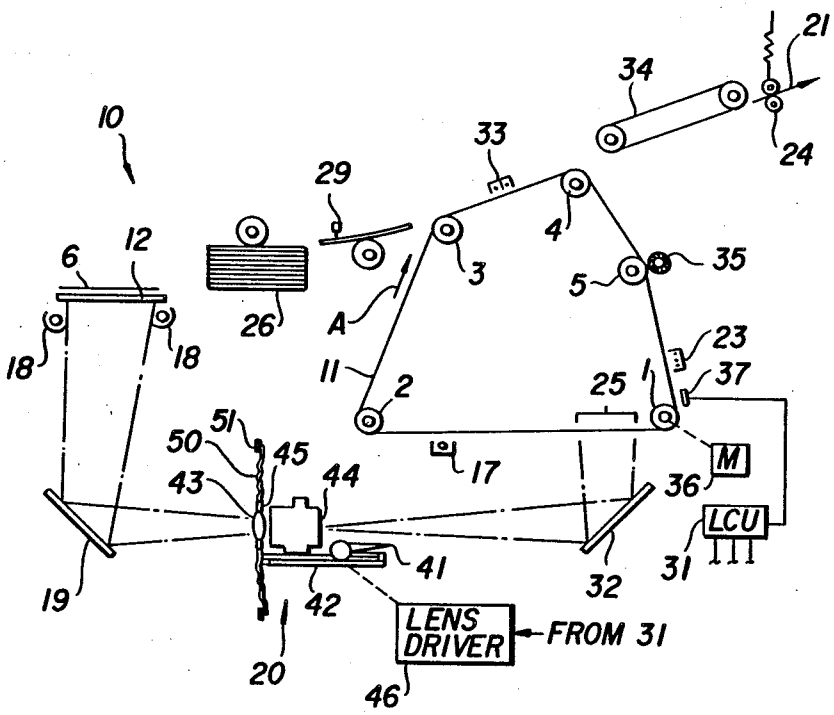
FIG. 1 is a schematic elevational view of a portion of an electrophotographic apparatus made in accordance with the invention.

For a general understanding of an electrostatic type reproduction machine or copier in which the invention may be incorporated, reference is made to the drawing FIG. 1 wherein various components of an exemplary copier machine, designated generally by the numeral 10, are schematically illustrated. As in most electrostatic type machines, a light image of an original or object 6 such as a document sheet to be copied or reproduced is projected onto the sensitized surface of a photoconductive web, herein in the form of a continuously moving endless belt 11 supported on rollers 1–5, to form an electrostatic latent image thereon. A motor M is coupled to one of the rollers for driving means. Synchronization of the operation of the various stations forming the apparatus is provided by a logic and control unit (LCU) 31 which in turn receives signals from an encoder 37 that senses indicia associated with the web 11. The latent image is then developed as by means of magnetic brushes at a development area 17 to form a xerographic powder image, corresponding to the latent image on web or belt 11. The powder image is then elecrostatically transferred to a support surface such as a copy sheet 21 and then permanently fixed by fusing apparatus 24.

To reproduce an original document sheet 6, the original is illuminated while supported in a plane on glass platen 12. The timing of the flash of xenon flash lamps 18 is controlled by a logic and control unit (LCU) 31 and related to the travel of the web 11 to expose the web to the images of the document sheet. The lamps flood the document sheet with light and a reflected image of the document sheet is transmitted via mirror 19, lens assembly 20, and mirror 32 in focus to an area 25 lying in the plane of the web 11. One or more corona charging units, exemplified by corona charger 23, is located upstream of the exposure area 25, and applies a uniform primary electrostatic charge, of say negative polarity, to the web 11 as it passes the charger and before it enters the exposure area. The photoconductive properties of the web cause the primary charge in the exposed areas of the web to be discharged in that portion struck by the exposure light. This forms latent imagewise charge patterns on the web in the exposed areas corresponding to the image on the document sheet. Thereafter, travel of the web then brings the area bearing the latent images into the development area 17. The development area, as has been noted, may comprise a magnetic brush development station. Toner particles in station 17 exhibit a triboelectric charge of opposite polarity to the latent imagewise charge pattern. An actuator not shown may selectively move a backup roller into contact with the web 11 to deflect the web from its travel path into operative engagement with a magnetic brush. The charged toner particles of the engaged magnetic brush are attracted to the oppositely charged latent imagewise pattern to develop the pattern.

The developed image frame must be transferred to a receiver sheet to form a reproduction of the original document sheet. Briefly, this is accomplished by feeding a receiver sheet or support 21, from a supply stack stored in hopper 26, in synchronism with movement of the image frame so that the receiver sheet engages the web and is registered by sheet registration mechanism 29 with the image frame in accordance with well known techniques. The image is transferred to the copy sheet by charger 33 that includes a transfer charger and detack charger. The copy sheet is separated from the web and conveyed by vacuum transporter 34 to roller fuser 24 and then to an exit hopper or accessory finishing unit not shown.

While the image is being fixed in fuser 24, the web 11 continues to travel about its path and proceeds through a cleaning area including a cleaning brush 35.

The lens assembly 20 includes a solenoid actuated shutter 41 for conrolling light to he photoconductive web. The shutter is shown in FIG. 1 in its light unblocking position. The shutter is supported on a conventional carriage 42 which also supports lens members 43 and 44. Lens member 43 is a single element lens that is supported within a frame 45 that is in turn movably connected relative to lens member 44 by conventional means not shown but which may comprise slide rails upon which frame 45 slides relative to lens member 44. A cam mounted on lens member 44 and respective cam follower associated with lens 43 may be used to establish the appropriate distances between lens members 43 and 44 for proper focusing of the image on area 25 of web 11. The lens member 44 may be a multi-element lens.

Figure 2:
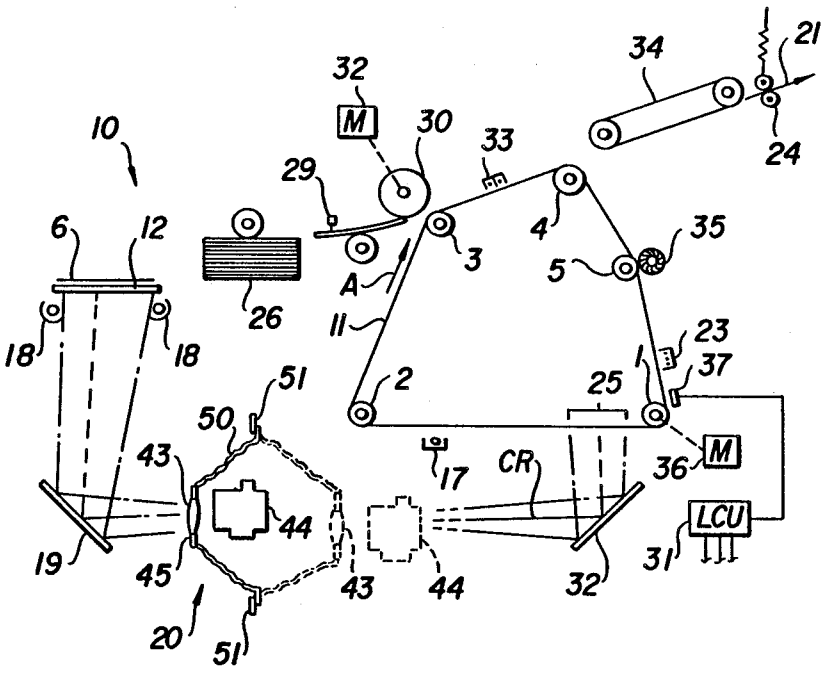
FIG. 2 is a view similar to that of FIG. 1, but showing a bellows and lens assembly in each of two different positions with certain details omitted for purposes of clarity; and FIGS. *3a–3c* are cross-sectional views of a portion of the bellows of the invention in different positions of use.

In order to adjust the magnification/reduction ratio of the image upon area 25, the carriage 42 with its accompanying lens members and shutter is moved prior to initiating exposure and in accordance with, for example, inputs provided by the operator to a position providing a desired magnification or reduction of image size. Selection buttons are provided on the copier's operator control panel to select the desired magnification or reduction. In response to such selection, an electrical signal is provided to the LCU 31, which in turn provides an electrical signal to a lens driver motor 46 which is mechanically coupled to carriage 42. The carriage then moves to either the left or the right to the required position for the magnification or reductions selected. In addition, the lens member 43 is moved relative to lens member 44 to maintain the image in focus. It is preferred also to move the carriage on a generally diagonal path relative to the central image light ray (CR) to maintain registration of the image upon the image area 25. In FIG. 2, two positions of lens member 43, 44 are shown. In the position shown in full lines the lens members 43, 44 are in position for forming a magnified or enlarged image of the document sheet 6 upon image area 25. In the position of the lens members 43, 44 shown in phantom, the lens members provide a reduced image of document sheet 6 upon image area 25.

As will be noted in FIGS. 1 and 2, a bellows assembly 50 is provided between a stationary frame 51 and lens frame 45. The bellows assembly 50 blocks stray light from entering and exposing the photosensitive web 11. In the prior art, a relatively large bellows would be required to accommodate the extent of travel of the movable lens member(s) described herein. To reduce the size of the required bellows I have provided a bellows that is used both in its normal and everted states. The normal state of the bellows is shown in the phantom illustration in FIG. 2. One end of the bellows assembly is attached to frame 51 by adhesive or clamping and the other end attached to frame 45. When the carriage (not shown in FIG. 2) is moved to the left so as to move lens members 43, 44 to any of several selectable image magnification positions, the bellows evert. The use of the everting bellows substantially reduces the size of the bellows but retains the light restricting functions of non-everting bellow assemblies.

Reference will now be made to FIG. 3 which illustrates a portion of the bellows assembly and shows the structure thereof that facilitates the everting of the bellows assembly as it is moved.

Figure 3A:
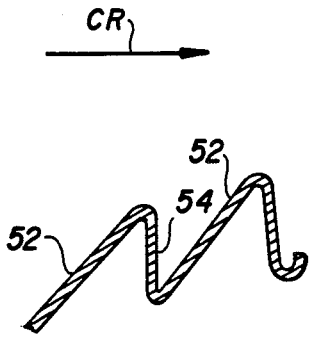

In FIG. 3*a*, a small portion of the bellows assembly is shown in cross-section and it may be noted that it is a pleated member and that each "rise" segment 52 of the pleated member is about twice the length of each "run" segment 54. The thickness of the bellows, it will be noted, is exaggerated in this figure. The bellows in FIG. 3*a* is in a position wherein the lens members 43, 44 image a reduced image of the document sheet 6 upon the web 11. This position is also shown in the phantom sketch of FIG. 2.

Figure 3B:
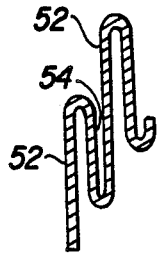
Figure 3C:
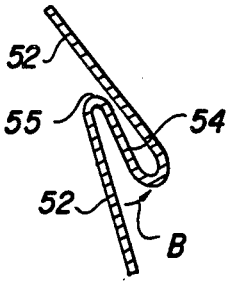

When the bellows assembly is collapsed from its state for image reduction, the rise and run segments 52, 54 now move closer together and the hinge-like flexible connection therebetween, due to the nature of the rubber-like material of which it is constructed, absorbs energy. The bellows of FIG 3*b* is shown in a position wherein the lens members 43, 44 image a full size image of the document upon the web 11. This position is also shown in FIG. 1. Upon movement of the lens members 43, 44 further to the left, the energy in the hinge 55 begins to be released and urges the pivoting of the run segments 54 in the direction of arrow B (see FIG. 3*c*) about their hinge points 55 to facilitate everting of the bellows. Furthermore, flexure of the rise members 52 due to the force created during movement of the lens members also urges pivoting of the run segments about their hinge points to facilitate eversion of the bellows. In FIG. 2 the bellows shown in real lines is everted from that shown in phantom. For increased magnification ratios, the lens members 43, 44 are moved as close as possible to mirror 19. It will be noted that for all magnification/reduction ratios there is no blocking of light reflected from the document towards mirror 19.

While the invention has been disclosed with regard to an electrophotographic reproduction apparatus, other reproduction apparatus such as cameras, etc., employing bellows may employ an everting bellows as described herein.

A preferred material found to be suitable for the everting bellows is silicone rubber, an example of which is Dow Corning #595 Liquid Injection Material. However, other materials will also be suitable.

The invention has been described in detail with particular reference to preferred embodiments thereof. However, it will be understood that variations and modifications may be effected within the spirit and scope of the invention.

I claim:

1. A reproduction apparatus comprising:

means for supporting a radiation sensitive member for exposure;

optical means including one or more optical elements for forming an image on said radiation sensitive member;

means for supporting an optical member of said optical means in each of at least two positions in both of which positions the optical member is positioned in an optical path for forming an image upon the radiation sensitive member;

a bellows coupled to said optical member; and means for supporting said bellows such that the orientation of the bellows is everted when in one of said at least two positions versus its orientation in the other of said at least two positions.

2. The reproduction apparatus of claim 1 wherein:

the bellows has a plurality of pleats and wherein the rise portions of at least most of said pleats is at least about two times the length of the run portions of the pleats.

* * * * *